US008186130B2

(12) United States Patent
Van Der Meijden et al.

(10) Patent No.: US 8,186,130 B2
(45) Date of Patent: May 29, 2012

(54) METHOD FOR INSTALLING AN ELEVATOR AND METHOD FOR INSTALLING THE GUIDE RAILS OF AN ELEVATOR

(75) Inventors: Gert Van Der Meijden, Otterlo (NL); Jos Van Den Heuvel, NN'S-Hertogengosch (NL)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/833,475

(22) Filed: Jul. 9, 2010

(65) Prior Publication Data

US 2010/0287876 A1 Nov. 18, 2010

Related U.S. Application Data

(63) Continuation of application No. PCT/FI2008/000145, filed on Dec. 18, 2008.

(30) Foreign Application Priority Data

Jan. 23, 2008 (FI) ..... 20080056

(51) Int. Cl.
*B66B 7/02* (2006.01)

(52) U.S. Cl. ..... 52/745.17; 52/741.1; 52/30; 187/249; 187/406; 187/411

(58) Field of Classification Search ..... 52/30, 741.1, 52/745.17; 187/249, 401, 406–408, 411
See application file for complete search history.

(56) References Cited

U.S. PATENT DOCUMENTS 2,420,903 A * 5/1947 Noble ..... 182/144
3,851,736 A * 12/1974 Westlake et al. ..... 52/30
5,020,641 A * 6/1991 Olsen et al. ..... 187/408
6,672,013 B1 * 1/2004 Glassey et al. ..... 52/30
7,562,744 B2 * 7/2009 Mustalahti et al. ..... 187/266

FOREIGN PATENT DOCUMENTS

EP 1254070 B1 3/2004
JP 11-335030 A 12/1999
WO WO 2005/030630 A1 4/2005

* cited by examiner

*Primary Examiner* — William Gilbert
*Assistant Examiner* — Matthew J Smith
(74) *Attorney, Agent, or Firm* — Birch, Stewart, Kolasch & Birch, LLP

(57) ABSTRACT

The object of the invention is a method for installing an elevator, in which method the guide rails of the car are installed by fixing the guide rail sections into position from the bottom upwards. After installation into position of the lowermost guide rail section at least one working platform is built between the guide rails of the lowermost guide rail section, the guide rails of the second guide rail section are fixed as an extension of the guide rails of the lowermost guide rail section using the working platform as an aid, diverting pulleys are fixed to the top ends of the guide rails of the second guide rail section, a hoist and the rope suspension of the working platform are fitted to the working platform, in which rope suspension the hoisting rope is led at its first end from the hoist over the diverting pulleys and under the diverting pulleys that are in connection with the working platform to its fixing point of the second end on the working platform, and the working platform is lifted to the next working height by means of the hoist and is locked into position.

20 Claims, 5 Drawing Sheets

Figure 1:
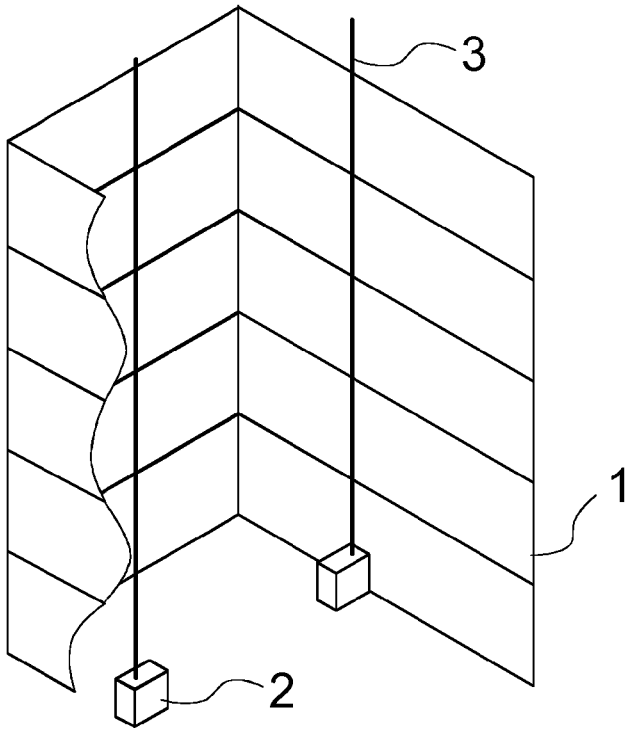

METHOD FOR INSTALLING AN ELEVATOR AND METHOD FOR INSTALLING THE GUIDE RAILS OF AN ELEVATOR

This application is a Continuation of copending PCT International Application No. PCT/FI2008/000145 filed on Dec. 18, 2008, and for which priority is claimed under 35 U.S.C. §120; and this application claims priority of Application No. 20080056 filed in Finland on Jan. 23, 2008 under 35 U.S.C. §119; the entire contents of all are hereby incorporated by reference into the present application.

The object of the invention is a method for installing an elevator as defined in the preamble of claim 1 and a method for installing the guide rails of an elevator as defined in the preamble of claim 11.

More particularly, the object of the invention is the installation, without a lifting beam and without scaffolding, of the guide rails of the car of an elevator. In connection with the installation of the guide rails, it is easy to also install e.g. a modular elevator hoistway comprised of parts.

According to prior art the guide rails of the car of an elevator are installed e.g. such that guide rail sections of a certain length are fixed into position one above the other in sequence from the bottom upwards. Often different scaffolds and hoists, which are in use at the construction site, are used as an aid. One method is to use in conjunction with the installation a lifting beam, installed above the hoistway in the top part of the building, to which the construction-time auxiliary hoists that are needed are fixed. Often, however, especially in old houses and in elevators to be installed special locations, such as e.g. in stairwells, a problem is that it is difficult to find a suitable and safe placement location for the aforementioned lifting beam. This is also affected by the fact that the installation of this type of lifting beam is a slow and expensive procedure in terms of its costs.

The purpose of this invention is to eliminate the aforementioned drawbacks and to achieve a reliable, inexpensive and safe method, which enables the installation of the guide rails of the elevator car without scaffolding and without an expensive hoisting beam being installed above the hoistway. The method according to the invention for installing an elevator is characterized by what is disclosed in the characterization part of claim 1. The method according to the invention for installing the guide rails of an elevator is characterized by what is disclosed in the characterization part of claim 11. Correspondingly, other embodiments of the invention are characterized by what is disclosed in the other claims. Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments.

An advantage of the method according to the invention is a simple, inexpensive and safe method that enables the installation of an elevator and more particularly of the guide rails of an elevator, in which there is no need for awkward scaffolds that cause hazards or for an expensive lifting beam that is awkward to position. Safety is promoted by, among other things, the fact that in the top part of the building a lifting beam is not needed, nor are any components necessary to the installation that would perhaps be in the way of other builders and thus in danger of being damaged or, if dropped, of injuring people working in the hoistway below. Another advantage is the speed of installation, because time is not spent on seeking and preparing a safe and practical place to locate the lifting beam or on disassembling and re-assembling the scaffolds. A further advantage is that the installation of the elevator does not disrupt other building work and correspondingly the installation of the elevator is not dependent on a schedule for e.g. obtaining cranes that are in other construction use for use in installation of the elevator.

In the method for installing an elevator, at least the guide rails of the car of the elevator are installed by fixing the guide rail sections into position in sequence from the bottom upwards. The method comprises at least the following phases after the installation into position of the lowermost guide rail section:

- at least one working platform is built between the guide rails of the lowermost guide rail section;
- the guide rails of the second guide rail section are fixed as an extension of the guide rails of the lowermost guide rail section using the built working platform as an aid;
- diverting pulleys are fixed to the top ends of the guide rails of the second guide rail section;
- a hoist is fitted to the working platform for raising the working platform upwards;
- the rope suspension of the working platform, in which the hoisting rope is arranged to pass over the diverting pulleys at the top end of the guide rails, is fitted;
- the working platform is lifted to the next working height by means of the hoist and is locked into position.

In the method for installing the guide rails of an elevator, at least the guide rails of the car of the elevator are installed by fixing the guide rail sections into position in sequence from the bottom upwards. The method comprises at least the following phases after the installation into position of the lowermost guide rail section:

- the guide rails of the second guide rail section are fixed as an extension of the guide rails of the lowermost guide rail section,
- diverting pulleys are fixed to the top ends of the guide rails of the second guide rail section,
- the hoisting rope of the hoist on the working platform is arranged to pass over the diverting pulleys and the working platform is suspended supported by the hoisting rope,
- the working platform is lifted to the next working height by means of the hoist.

Figure 2:
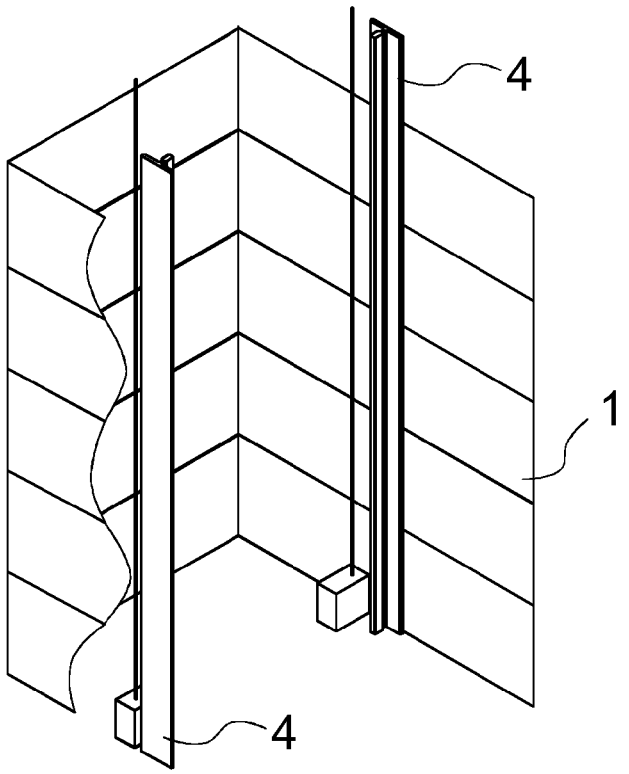
Figure 3:
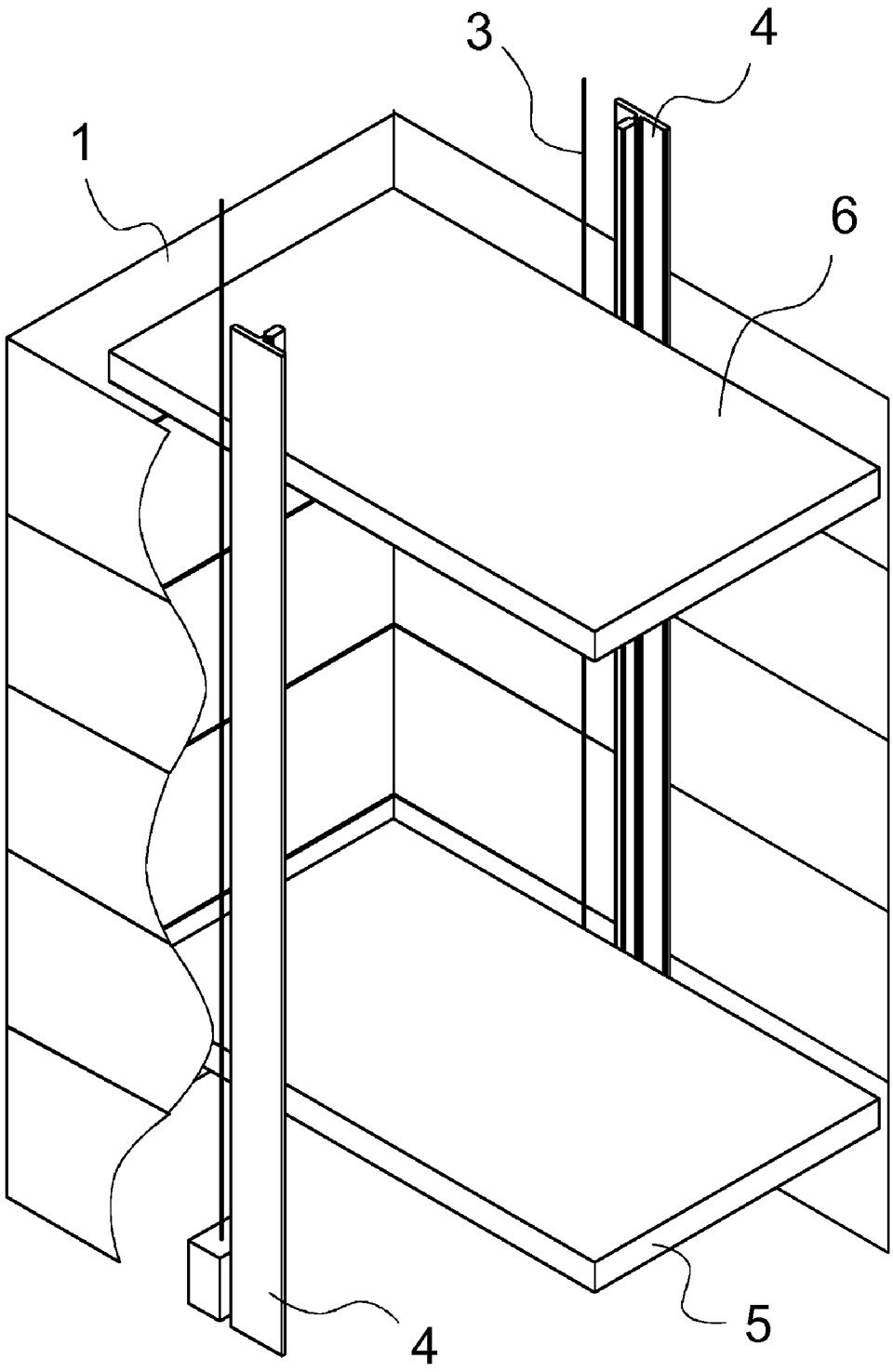
Figure 4:
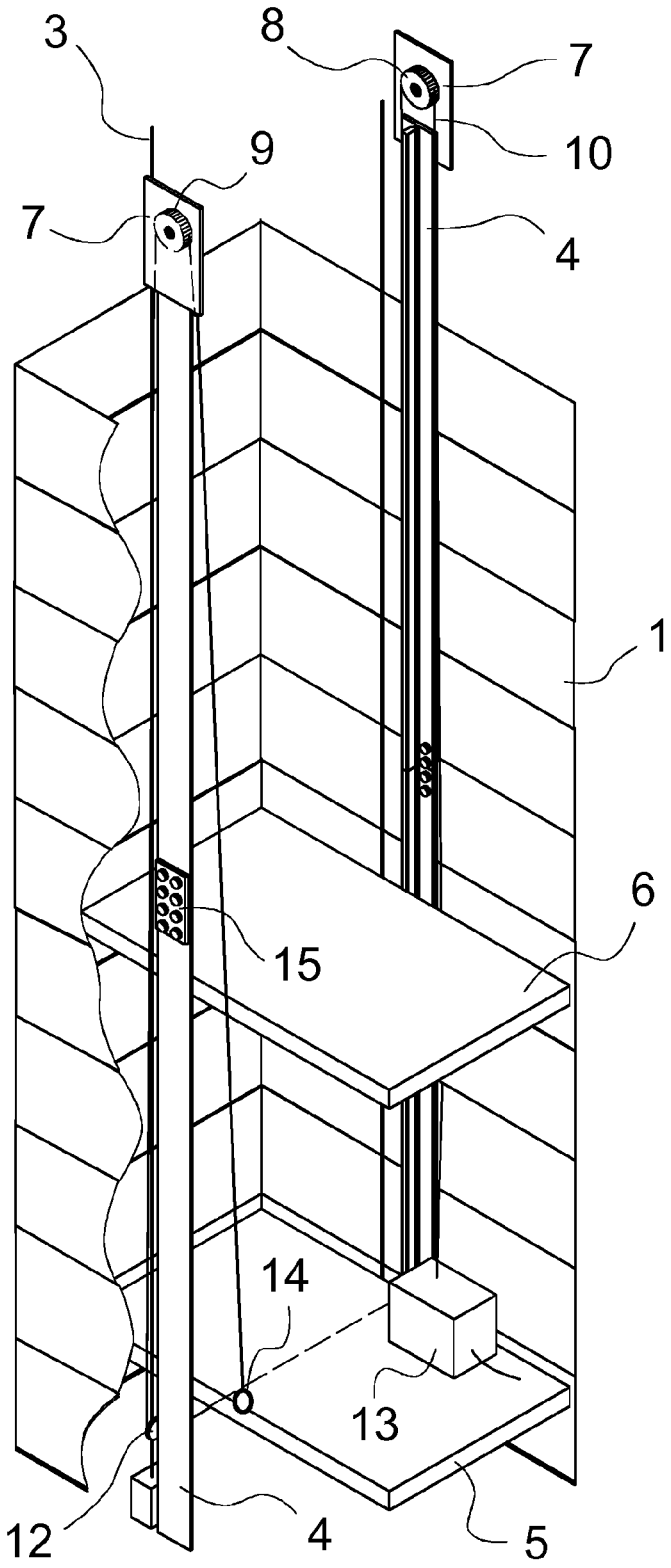
Figure 5:
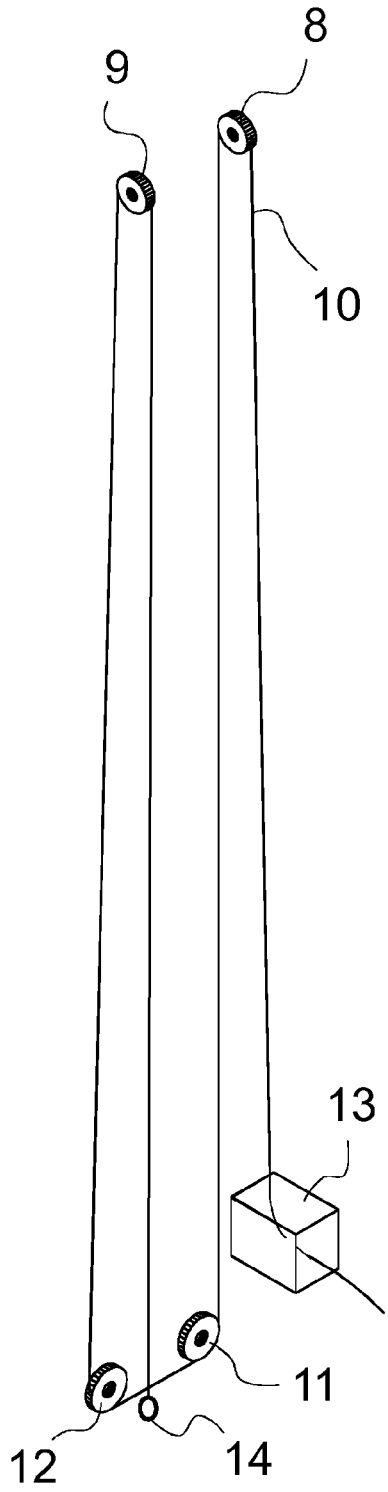
Figure 6:
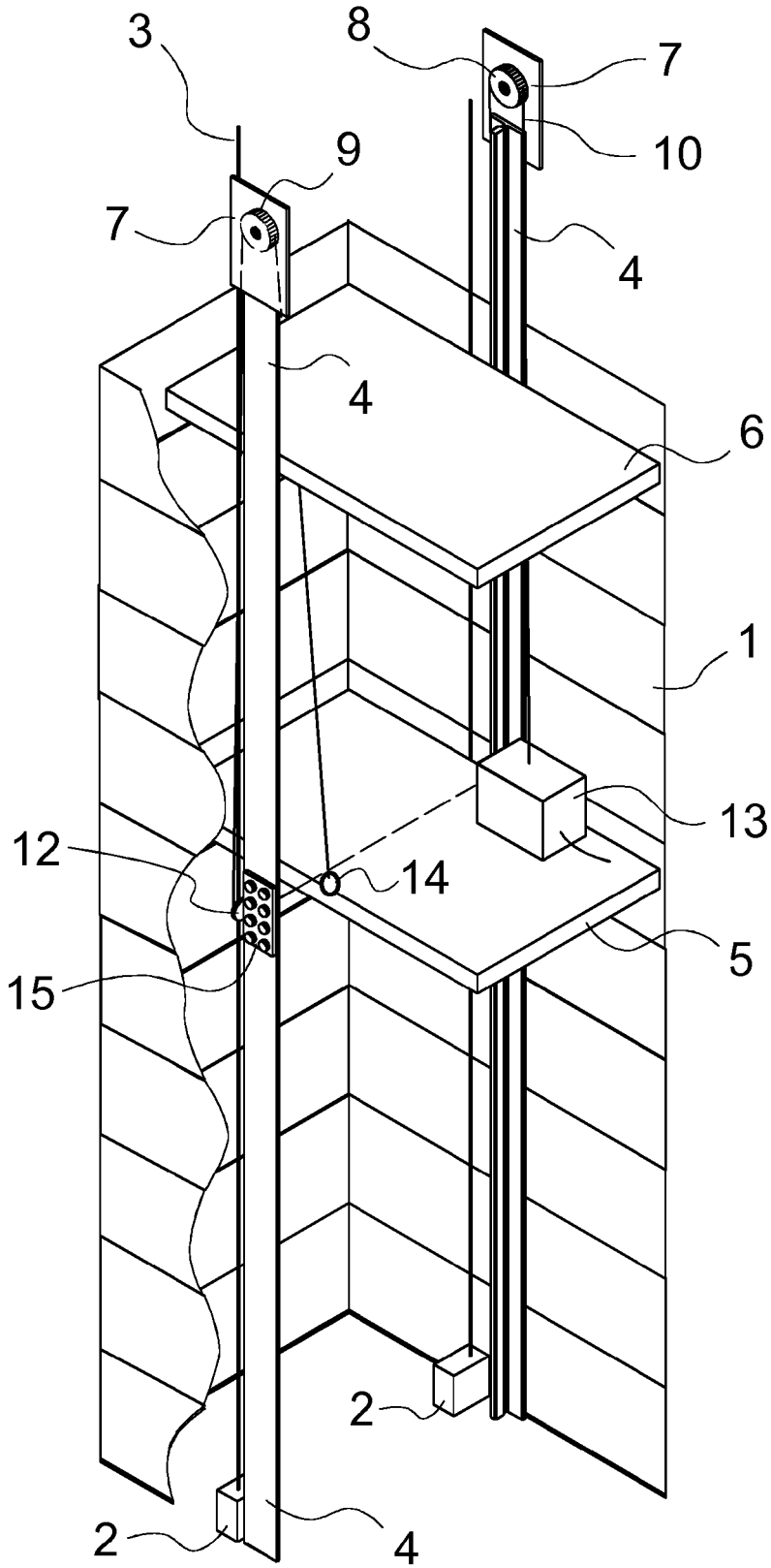
Figure 7:
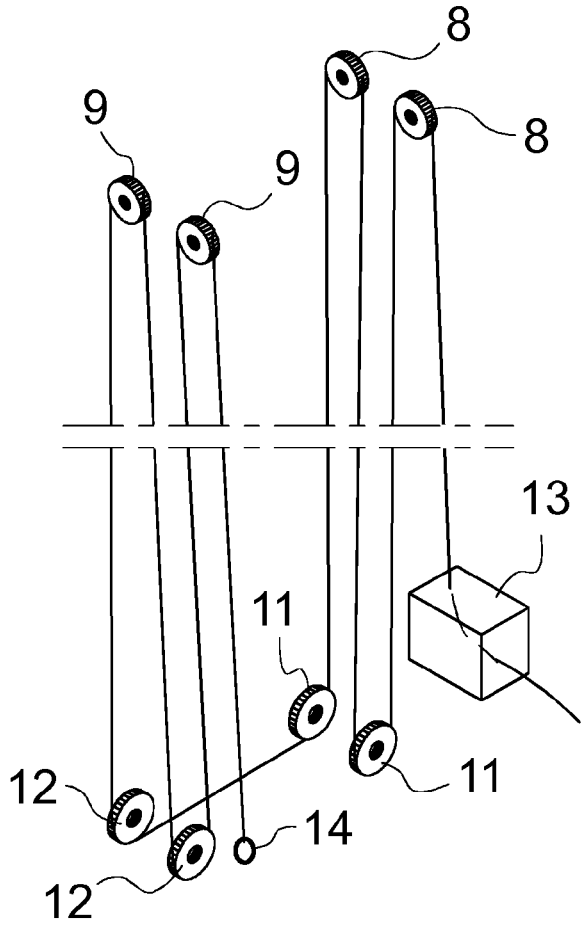
Figure 8:
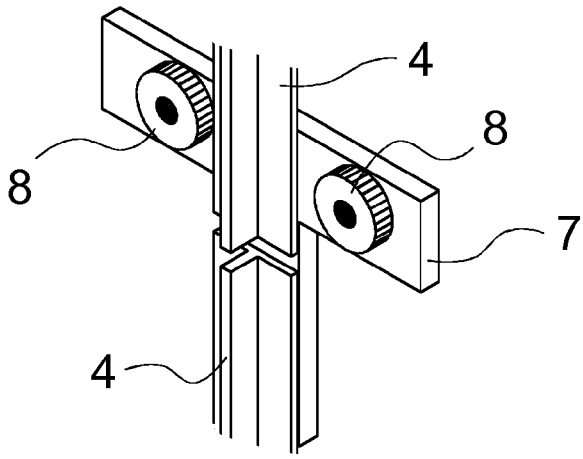

In the following, the invention will be described in detail by the aid of an example of its embodiment with reference to the attached drawings, wherein FIG. 1 presents a simplified and diagrammatic oblique top view of an installation situation according to the invention right in the initial phase of the installation, FIG. 2 presents a simplified and diagrammatic oblique top view of an installation situation according to the invention, in which the lowermost guide rails have been installed, FIG. 3 presents a simplified and diagrammatic oblique top view of an installation situation according to the invention, in which two installation platforms have been installed in the bottom part of the hoistway, FIG. 4 presents a simplified and diagrammatic oblique top view of an installation situation according to the invention, in which the second guide rail sections have been installed as an extension of the first ones, FIG. 5 presents a simplified and diagrammatic view of a roping arrangement used in the situation according to FIG. 4, FIG. 6 presents a simplified and diagrammatic oblique top view of an installation situation according to the invention, in which the installation platforms have been raised to the next height position, FIG. 7 presents a simplified and diagrammatic view of a second preferred roping arrangement used in the method according to the invention, and FIG. 8 presents a simplified and diagrammatic view of one rope pulley solution used in the roping arrangement presented in FIG. 7.

FIG. 1 presents the situation at the start of the installation. At first the laser tools 2 intended for precise alignment are positioned. There are at least two laser tools 2, one for each guide rail wall. By means of the laser tools 2 the bottom part of the wall of the elevator hoistway is installed from wall elements 1. When a height has been reached in the installation of the walls above which it is no longer possible to reach without ladders or other auxiliary means, the lowermost guide rails 4 are fixed into position by means of the laser tools 2, one guide rail 4 to each guide rail wall. FIG. 2 presents this phase. The guide rails 4 are fixed to some suitable firm position in the building. The fixing of the guide rails 4 to the building is not shown in the figures.

After fixing the lowermost guide rails a car sling, which comprises at least one working platform, is constructed. The solution according to the embodiment presented in FIG. 3 comprises two platforms one above the other; a lower platform 5 and a higher platform 6. The platforms 5 and 6 are fixed to each other and move always at the same time in the vertical direction. The fixing of the platforms 5 and 6 to each other is not shown in the figures for the sake of clarity. The vertical distance of the platforms 5 and 6 from each other is essentially the same as the height of the final elevator car. The support and guiding of the platforms from the guide rails 4 is fitted such that the upper platform 6 can be driven to and locked at a suitable distance above the top ends of the guide rails that have already been installed. One suitable distance is e.g. approx. one meter. In this case the installation of the next guide rails 4 can be performed from essentially higher than the top ends of the guide rails 4 that have already been installed, in which case when using guide rails that are at the most approx. 2.5 m long, neither ladders nor stands are needed on the platforms, but instead the fitters can reach the top end of the new guide rails 4 when standing directly on the platform 6.

When the upper platform is in this way driven a suitable distance above the top ends of the guide rails 4 that have already been installed, the next guide rails 4 are installed from the upper platform 6 as an extension of the lowermost guide rails 4 that have already been installed i.e. above the lowermost guide rails 4. The extension joint is reinforced with bolts from behind the guide rails and with a guide rail extension plate 15. This situation is presented in FIGS. 4 and 5, in the latter of which for the sake of clarity only the rope suspension is presented. In addition, the diverting pulleys 8 and 9 are disposed on the top ends of the upper guide rails e.g. by means of a support element 7 fixed to the top end of the guide rails 4. In this phase of the installation at the latest a Tirak hoist 13 or a corresponding hoist, with which the platforms 5 and 6 are in the future lifted upwards, is disposed on the lower platform 5. For this purpose a hoisting rope 10 is arranged to pass from the Tirak hoist 13 initially upwards to the diverting pulley 8 at the top end of the uppermost guide rail 4 and passing over the top of it the hoisting rope 10 is led downwards to the diverting pulley 11 fixed to the lower platform 5, around the bottom of which diverting pulley the hoisting rope 10 is led onwards below the lower platform 5 to the diverting pulley 12 on the other side of the platform 5 and passing around the bottom of it the hoisting rope 10 is led upwards to the diverting pulley 9 at the top end of the second guide rail 4 and passing over the top of it the hoisting rope 10 is led again downwards to its fixing point 14 fitted on the lower platform 5. Thus the suspension ratio is 1:4. When the Tirak hoist 13 pulls the hoisting rope 10, the platforms 5 and 6 rise upwards. The supporting force needed for lifting the working platform 5, 6 can in this case be taken from the aforementioned diverting pulleys 8, 9.

FIG. 6 presents a situation in which the platforms 5 and 6 have been lifted to the next installation location. After the lifting of the platforms they are fixed firmly to the guide rails 4, after which the diverting pulleys 8, 9 are detached from the top ends of the guide rails 4 and fixed e.g. to support elements in the temporary fixing location on the upper platform 6, which are not presented in the figures.

After this the next part of the hoistway and the next guide rails are installed as an extension of the guide rails already installed, and the diverting pulleys 8 and 9 with the support elements 7 are fixed to the top ends of the new guide rails 4. Then the platforms 5 and 6 are lifted again upwards by the amount of the next phase and thus the installation continues until the guide rails and the hoistway are installed to their final heights.

FIGS. 7 and 8 present one preferred embodiment of the invention. In it there are two diverting pulleys 8 in place of one diverting pulley 8 on the top end of the guide rails 4, which diverting pulleys are not directly above the guide rail 4 as was the one diverting pulley 8 in the previous embodiment. The diverting pulleys 8 are now at the side of the guide rails and out of the way of the guide rail line and thus they do not prevent installation of the upper guide rail when the diverting pulleys 8 are still in position. In FIG. 8 the upper guide rail 4 is just being installed as an extension of the lower guide rail 4 and a gap is deliberately still left between the guide rails. Although FIG. 8 presents only the placement of the diverting pulleys 8 at the end of the guide rail, also the diverting pulleys 9 on the top end of the guide rail 4 on the other wall are disposed in a corresponding manner to the sides of the guide rail 4.

The hoisting rope 10 is suspended in this solution e.g. such that the hoisting rope 10 is fitted to pass from the Tirak hoist 13 initially upwards to the first diverting pulley 8 at the top end of the uppermost guide rail 4 and passing over the top of it the hoisting rope 10 is led downwards to the first diverting pulley 11 fixed to the lower platform 5, around the bottom of which diverting pulley 11 the hoisting rope 10 is led again upwards to the second diverting pulley 8 at the top end of the uppermost guide rail 4 and passing over the top of it the hoisting rope 10 is led again downwards to the second diverting pulley 11 fixed to the lower platform 5 and onwards under the lower platform 5 to the first diverting pulley 12 on the other side of the platform 5 and passing around the bottom of it the hoisting rope 10 is led upwards to the first diverting pulley 9 at the top end of the second guide rail 4 and passing around the top of it the hoisting rope 10 is led again downwards to the second diverting pulley 12 fixed to the lower platform 5 and passing around the bottom of it the hoisting rope 10 is led again upwards to the second diverting pulley 9 at the top end of the second guide rail 4 and passing around the top of it the hoisting rope 10 is led again downwards to its fixing point 14 fitted on the lower platform 5. Thus the suspension ratio is now 1:8 and when the Tirak hoist pulls the hoisting rope 10 the platforms 5 and 6 rise upwards.

The method according to the invention for installing an elevator is described above. In the method according to the invention for installing the guide rails of an elevator one proceeds in the manner described above and illustrated in the figures. Thus in the method, at least the guide rails 4 of the car of the elevator are installed by fixing the guide rail sections into position in sequence from the bottom upwards. In the method the guide rails 4 of the lowermost guide rail section are installed, after which the guide rails 4 of the second guide rail section are fixed as an extension of the guide rails 4 of the lowermost guide rail section using the working platform 5, 6 as an aid. After this the diverting pulleys 8, 9 are fixed to the top ends of the guide rails 4 of the second guide rail section and the hoisting rope 10 of the hoist 13 on the working platform is arranged to pass over the diverting pulleys 8, 9 and the working platform 5, 6 is suspended supported by the hoisting rope 10. After this, the working platform 5, 6 is lifted to the next working height by means of the hoist 13. The supporting force needed for lifting the working platform can in this case be taken from the aforementioned diverting pulleys 8, 9. After this the working platform is locked into position and the guide rails of the next guide rail section are installed from the working platform and the diverting pulleys 8 and 9 with the support elements 7 are fixed to the top ends of the new guide rails 4. Then the platforms 5 and 6 are lifted again upwards by the amount of the next phase and thus the installation continues, until the guide rails and the hoistway are installed to their final heights. In other respects the method for installing an elevator described earlier in this application can be followed.

It is obvious to the person skilled in the art that the invention is not limited solely to the examples described above, but that it may be varied within the scope of the claims presented below. Thus, for example, instead of e.g. two platforms, the installation method can be used e.g. with only one platform.

It is also obvious to the person skilled in the art that one or more hoists can be installed on the platforms for lifting the guide rails and other components to the working height. Likewise, the upper working platform can also comprise safety railings.

It is further obvious to the person skilled in the art that although e.g. essentially simultaneous installation of both the elevator hoistway and the guide rails is described above, the guide rails can very well be installed with this method also separately, without essentially simultaneous installation of the walls of the elevator hoistway.

The invention claimed is:

1. A method for installing an elevator, in which method at least guide rails of a car of the elevator are installed by fixing guide rail sections into position in sequence from a bottom upwards, the method comprising installing into position a lowermost guide rail section;

installing at least one working platform between the guide rails of the lowermost guide rail section;

fixing guide rails of a second guide rail section as an extension of the guide rails of the lowermost guide rail section using the working platform as an aid;

fixing diverting pulleys to top ends of the guide rails of the second guide rail section;

fixing diverting pulleys to the at least one working platform;

fitting a hoist to the working platform for lifting the working platform upwards;

fitting a rope suspension of the working platform with a hoisting rope;

securing a first end of a hoisting rope to the hoist; and arranging the rope suspension to pass from the hoist over the diverting pulleys at the top end of the guide rails and under the diverting pulleys of the working platform to a fixing point on the working platform.

2. The method according to claim 1, wherein a lower working platform and an upper working platform, that are a vertical distance from each other, are between the guide rails, the working platforms supported between each other and are fitted to move in the vertical direction simultaneously and to keep the vertical distance between the working platforms substantially the same.

3. The method according to claim 2, wherein when lifting the working platforms to a next working height the upper platform is locked at a height which is higher than the top ends of the guide rails that have already been installed and the installation of the next guide rails is performed from higher than top ends of the guide rails that have already been installed.

4. The method according to claim 2, wherein one or more separate hoists are fitted to the working platforms, by means of which the guide rails and other components are lifted to the working height.

5. The method according to claim 2, wherein a hoist that pulls the rope through itself is used as the hoist that lifts the working platforms.

6. The method according to claim 2, wherein the working platform is suspended on the hoisting rope such that the hoisting rope is fitted to pass from the hoist upwards to a first diverting pulley at the top end of the uppermost guide rail and over the top of the first diverting pulley to a second diverting pulley in connection with the platform, around the bottom of the second diverting pulley, below the platform to a third diverting pulley in connection with the platform on an other side of the platform and passing around the bottom of the third diverting pulley to a fourth diverting pulley at the top end of a second guide rail and passing over the top of the fourth diverting pulley to the fixing point fitted to the platform.

7. The method according to claim 2, wherein the working platform is suspended on the hoisting rope such that the hoisting rope passes from the hoist upwards to the first diverting pulley at the top end of the uppermost guide rail and over the first diverting pulley to a second diverting pulley in connection with the working platform, around the second diverting pulley to a third diverting pulley at the top end of the uppermost guide rail and passing over the third to a fourth diverting pulley that is in connection with the working platform and under the working platform to a fifth diverting pulley in connection with the working platform on an other side of the platform and passing around the fifth diverting pulley to a sixth diverting pulley at the top end of the second guide rail and passing around the sixth diverting pulley to a seventh diverting pulley in connection with the working platform and passing around the seventh diverting pulley to an eighth diverting pulley at the top end of the second guide rail and passing around the top of the eighth diverting pulley to the fixing point fitted to the platform.

8. The method according to claim 1, wherein one or more hoists are fitted to the working platforms.

9. The method according to claim 8, wherein a hoist that pulls the rope through itself is used as the hoist that lifts the working platforms.

10. The method according to claim 8, wherein the working platform is suspended on the hoisting rope such that the hoisting rope is fitted to pass from the hoist upwards to a first diverting pulley at the top end of the uppermost guide rail and over the top of the first diverting pulley to a second diverting pulley in connection with the platform, around the bottom of the second diverting pulley, below the platform to a third diverting pulley in connection with the platform on an other side of the platform and passing around the bottom of the third diverting pulley to a fourth diverting pulley at the top end of a second guide rail and passing over the top of the fourth diverting pulley to the fixing point fitted to the platform.

11. The method according to claim 8, wherein the working platform is suspended on the hoisting rope such that the hoisting rope passes from the hoist upwards to the first diverting pulley at the top end of the uppermost guide rail and over the first diverting pulley to a second diverting pulley in connection with the working platform, around the second diverting pulley to a third diverting pulley at the top end of the uppermost guide rail and passing over the third to a fourth diverting pulley that is in connection with the working platform and under the working platform to a fifth diverting pulley in connection with the working platform on an other side of the platform and passing around the fifth diverting pulley to a sixth diverting pulley at the top end of the second guide rail and passing around the sixth diverting pulley to a seventh diverting pulley in connection with the working platform and passing around the seventh diverting pulley to an eighth diverting pulley at the top end of the second guide rail and passing around the top of the eighth diverting pulley to the fixing point fitted to the platform.

12. The method according to claim 1, wherein a hoist that pulls the rope through itself is used as the hoist that lifts the working platforms.

13. The method according to claim 12, wherein the working platform is suspended on the hoisting rope such that the hoisting rope is fitted to pass from the hoist upwards to a first diverting pulley at the top end of the uppermost guide rail and over the top of the first diverting pulley to a second diverting pulley in connection with the platform, around the bottom of the second diverting pulley, below the platform to a third diverting pulley in connection with the platform on an other side of the platform and passing around the bottom of the third diverting pulley to a fourth diverting pulley at the top end of a second guide rail and passing over the top of the fourth diverting pulley to the fixing point fitted to the platform.

14. The method according to claim 12, wherein the working platform is suspended on the hoisting rope such that the hoisting rope passes from the hoist upwards to the first diverting pulley at the top end of the uppermost guide rail and over the first diverting pulley to a second diverting pulley in connection with the working platform, around the second diverting pulley to a third diverting pulley at the top end of the uppermost guide rail and passing over the third to a fourth diverting pulley that is in connection with the working platform and under the working platform to a fifth diverting pulley in connection with the working platform on an other side of the platform and passing around the fifth diverting pulley to a sixth diverting pulley at the top end of the second guide rail and passing around the sixth diverting pulley to a seventh diverting pulley in connection with the working platform and passing around the seventh diverting pulley to an eighth diverting pulley at the top end of the second guide rail and passing around the top of the eighth diverting pulley to the fixing point fitted to the platform.

15. The method according to claim 1, wherein the working platform is suspended on the hoisting rope such that the hoisting rope is fitted to pass from the hoist upwards to a first diverting pulley at the top end of the uppermost guide rail and over the top of the first diverting pulley to a second diverting pulley in connection with the platform, around the bottom of the second diverting pulley, below the platform to a third diverting pulley in connection with the platform on an other side of the platform and passing around the bottom of the third diverting pulley to a fourth diverting pulley at the top end of a second guide rail and passing over the top of the fourth diverting pulley to the fixing point fitted to the platform.

16. The method according to claim 15, wherein after the lifting of the working platforms to the next working height, the diverting pulleys at the top ends of the guide rails are detached and fixed to temporary fixing position on the working platform.

17. The method according to claim 1, wherein the working platform is suspended on the hoisting rope such that the hoisting rope passes from the hoist upwards to the first diverting pulley at the top end of the uppermost guide rail and over the first diverting pulley to a second diverting pulley in connection with the working platform, around the second diverting pulley to a third diverting pulley at the top end of the uppermost guide rail and passing over the third to a fourth diverting pulley that is in connection with the working platform and under the working platform to a fifth diverting pulley in connection with the working platform on an other side of the platform and passing around the fifth diverting pulley to a sixth diverting pulley at the top end of the second guide rail and passing around the sixth diverting pulley to a seventh diverting pulley in connection with the working platform and passing around the seventh diverting pulley to an eighth diverting pulley at the top end of the second guide rail and passing around the top of the eighth diverting pulley to the fixing point fitted to the platform.

18. The method according to claim 17, wherein a new guide rail is installed above a previous one by positioning the new guide rail into position above the previous guide rail between the two diverting pulleys on a first wall and correspondingly the two diverting pulleys on the second wall, by fixing the new guide rail to a mounting with brackets and after the fixing by detaching the diverting pulleys from the guide rail below them and by moving the diverting pulleys with the support elements and rope to the top end of the new guide rail.

19. The method according to claim 1, wherein in connection with the installation of the guide rails of the elevator car, the walls of the elevator hoistway are installed essentially simultaneously from wall elements.

20. A method for installing the guide rails of an elevator, in which method at least the guide rails of a car of the elevator are installed by fixing guide rail sections into position in sequence from a bottom upwards, the method comprising:

installation into position of the guide rails of a lowermost guide rail section;

fixing the guide rails of a second guide rail section as an extension of the guide rails of the lowermost guide rail section;

fixing diverting pulleys to top ends of guide rails of the second guide rail section;

fitting a hoist to a working platform;

securing a first end of a hoisting rope to the hoist;

arranging a hoisting rope of the hoist to pass over the diverting pulleys and suspending the working platform by the hoisting rope; and securing a second end of the hoisting rope to the working platform.

* * * * *